US007423212B2

(12) United States Patent
Gallagher

(10) Patent No.: US 7,423,212 B2
(45) Date of Patent: Sep. 9, 2008

(54) INSTRUMENT SUPPORT STRUCTURE

(76) Inventor: Kevin T. Gallagher, 6391 Ardmore Dr., Brooklyn, OH (US) 44144

( * ) Notice: Subject to any disclaimer, the term of this patent is extended or adjusted under 35 U.S.C. 154(b) by 0 days.

(21) Appl. No.: 11/557,984

(22) Filed: Nov. 9, 2006

(65) Prior Publication Data

US 2007/0289430 A1 Dec. 20, 2007

Related U.S. Application Data

(60) Provisional application No. 60/804,704, filed on Jun. 14, 2006.

(51) Int. Cl.
*G10D 13/02* (2006.01)

(52) U.S. Cl. ..... 84/421

(58) Field of Classification Search ..... 84/421, 84/327, 329

See application file for complete search history.

(56) References Cited

U.S. PATENT DOCUMENTS

| | | | | |
|---|---|---|---|---|
| 2,510,799 | A | 6/1950 | Carley | |
| 2,717,437 | A | 9/1955 | De Mestral | |
| 3,037,416 | A | 6/1962 | Cunningham | |
| 3,114,951 | A | 12/1963 | De Mestral | |
| 3,323,698 | A | 6/1967 | Sottile | |
| 3,371,570 | A | 3/1968 | Lester | |
| 3,833,751 | A | 9/1974 | Chapman | |
| 3,894,464 | A | 7/1975 | Brooks | |
| 4,014,240 | A | 3/1977 | Pullen | |
| 4,084,477 | A | 4/1978 | Dominguez | |
| 4,188,851 | A | 2/1980 | Wolf | |
| 4,251,016 | A | 2/1981 | O'Rafferty | |
| 4,254,901 | A | 3/1981 | McIntosh | |
| 4,310,111 | A | 1/1982 | Brent | |
| 4,656,917 | A | 4/1987 | Van Halen | |
| 4,785,705 | A | 11/1988 | Patterson | |
| 4,858,801 | A | 8/1989 | Sameniego | |
| 5,000,071 | A | 3/1991 | Thomas | |
| 5,069,103 | A | 12/1991 | Healy | |
| 5,332,137 | A | 7/1994 | Violette | |
| 5,817,961 | A * | 10/1998 | Beck | 84/327 |
| 5,983,403 | A | 11/1999 | Neeley | |
| 6,359,203 | B1 | 3/2002 | Cronos | |
| 6,441,283 | B1 * | 8/2002 | Scott | 84/327 |
| 2003/0217635 | A1 | 11/2003 | Christou | |

* cited by examiner

*Primary Examiner*—Kimberly R Lockett
(74) *Attorney, Agent, or Firm*—DA Stauffer Patent Services LLC

(57) ABSTRACT

Method and apparatus for supporting an instrument, particularly support that places as much as possible of the instrument weight onto the instrument user's lower body (i.e., waist/hips/thighs and lower). A patch of a releasably adhering fabric is attached to the back of the instrument. The patch attachment is preferably temporary (removable) but if permanent, then preferably the permanent attachment is made to a removable and replaceable component of the instrument. A hanger that is removably attachable to the user's waist/hips/thighs is at least partially covered by a releasably adhering fabric that will mate with (releasably adhere to) the fabric of the patch on the instrument. Rigid forms of the hanger can be used to reduce twisting of the instrument in the vertical plane, and can also be used to provide support wherein the patch-to-hanger releasable adherence location is positioned above the location of the removable attachment to the user.

20 Claims, 4 Drawing Sheets

INSTRUMENT SUPPORT STRUCTURE

CROSS-REFERENCE TO RELATED APPLICATIONS

This application claims the benefit of, and incorporates in its entirety herein by reference, U.S. Provisional Patent Application No. 60/804,704, filed Jun. 14, 2006 by Kevin T. Gallagher.

TECHNICAL FIELD OF THE INVENTION

The present invention relates to method and structure for supporting an instrument while it is being played and, more particularly, the method and structure providing a removable attachment of the instrument to a player of it.

BACKGROUND OF THE INVENTION

Many devices, e.g., musical instruments, and particularly stringed instruments such as guitars (both acoustic and electrical) are typically supported by a strap that passes over the shoulder and/or around the back of the neck of the instrument user (player). This support arrangement places a fair amount of weight and stress on the upper shoulder/neck area as well as pressure on the back itself. Since many musicians prefer to rehearse standing, and are often expected to perform standing as well, the shoulder/neck support leads to fatigue in the muscle areas even for those in good health especially for long durations of rehearsal and/or performance. Furthermore, many modern electric guitars and especially electric basses are quite heavy, so that supporting an instrument during extended periods of play is fatiguing to a musician, which in turn impairs the musician's ability to play well. Consequently, a support system for a musical instrument should optimally distribute the instrument's weight comfortably upon the musician's body.

Similar considerations may on occasion apply to other musical instruments, such as a saxophone or synthesizer controller or an electronic drum device; or to any type of tool supported in front of a user's body, especially when such a tool requires two-handed operation by the user.

Thus users of shoulder/neck supported instruments are feeling a great need for a solution to this problem, and this need is most especially urgent for those with health problems in their back, neck and/or shoulder areas.

Other factors come into play as well.

A musician may prefer to play both while sitting and standing (possibly with performance gyrations), and the musician may be required to alternately stand and sit in a single performance, and may want to continue playing while transitioning between sitting and standing, as well as while gyrating. However, many existing support systems either function poorly in one or another of the playing positions, or are difficult to change especially while both hands are busy playing the instrument.

The prior art has attempted to provide support devices for relieving strain from the performer by supporting the guitar and other stringed instruments through the use of straps, levers, belts, etc. U.S. Pat. Nos. 2,510,799; 3,323,698; 3,894,464; 4,014,240; 4,188,851; 4,251,016; 4,656,917; and 4,785,705 are examples of prior art attempts to provide such support of the stringed instrument for the performer. Most of these prior art devices utilize straps that are passed over the shoulders, around the neck, or otherwise across the torso and terminate in clasps that may be attached to the stringed instrument to support it in front of the performer. However, they all share at least one common disadvantage. Little thought has been given to providing the performer with the ability to carry on the wild gyrations of his/her body and of the stringed instruments, as is expected and common during personal performances, and to allow the stringed instrument to be re-set or re-supported in the playing position, at the front of the performer's body, following cessation of these gyrations. Such an ability would allow the performer to continue playing the music without the stress and strain of continually supporting the instrument, or from interrupting their performance to reattach the guitar or other instrument to the support structure.

The apparently contradictory demands for support and freedom of expression, for simplicity and significant weight distribution, and for seated-position and standing-position play have led to the development of many musical-instrument support systems, such as straps and belts and belt-hooks. However, in this crowded field, the solutions previously developed fail to address all the issues, or in some cases create other performance difficulties such as requiring substantial time to don or remove, or such as interfering with or detracting from the appearance of the performer's costume, or such as affecting the acoustics, durability, and/or value of the instrument.

Another factor that should be considered is the effect of a support structure on the instrument case. Many of the more expensive/valuable instruments such as electric guitars are supplied with a custom made guitar case that very closely fits around the guitar body in order to protect it from banging around in the case. These custom cases can be quite expensive by themselves, and because of the purposely tight fit the case will not accommodate any significantly sized support structures added onto the guitar body.

Historically, the most popular support for acoustical or electric guitar or electric bass has been the common "guitar strap" which is attached to the lower end ("the base") of a guitar, from which point it passes behind the musician's back and forward over his or her shoulder, and is attached to either the tuner head of the instrument, or to the instrument's body near the neck. This type of support is simple, inexpensive to manufacture, familiar to musicians, quick to don or to remove, produces no discomfort to a female musician's breasts, and does not interfere with a musician's costume. Perhaps for these reasons, the common guitar strap has been the mainstay of guitar support systems for hundreds of years.

U.S. Pat. No. 6,359,203 to Cronos (2002) discloses a method and strap support assembly for holding a musical instrument in an upright position for alternate modes of play. A shoulder pad is added to a basic guitar strap, and an adjustable cord or strap is attached from the shoulder pad to the guitar's tuner head. Although this positions the guitar for both standing and sitting use, it does not take any of the weight of the guitar off the musician's shoulder and back. Although the shoulder pad helps somewhat by spreading out the weight over a larger portion of the shoulder area, the guitar still unequally pulls on one side of the neck, and the full weight still bears down on the spine/back of the musician.

In U.S. Pat. No. 4,254,901 to McIntosh (1981), an additional strap segment is connected to the rear of a basic guitar strap, from which point it passes over the musician's other shoulder to attach to the instrument. This distributes the weight equally on both shoulders and is much more comfortable, but still leaves all of the instrument weight bearing downward and forward on the musician's back. Furthermore, the extra strap makes donning and removing more difficult.

In U.S. Pat. No. 5,332,137 to Violette (1994), a belt is worn around a musician's waist, and from the rear center of this belt a strap segment passes over the musician's shoulder to attach to the instrument. Two short straps depend from the belt; and these are affixed to the rear surface of the instrument's body. This triangulated support will hold the instrument without swaying. Although this arrangement provides some weight redistribution to the musician's hips, the device is more expensive to manufacture, may interfere with the performer's costume, is time-consuming to don or remove, will not permit seated play and limits the range of movement for gyrating.

In U.S. Pat. No. 3,371,570 to Lester (1968), a flat hook ("lug member" 39, 39') is permanently attached to the rear of an instrument's body, permitting the musician to quickly place the hook over the top of the musician's pants so that the musician's trousers belt will support the weight of the instrument. The hook(s) are permanently affixed to the rear of the instrument by means of a "bridge member" 37 which is custom shaped to the guitar and glued to the edge of the guitar back. A disadvantage of this approach is that a serious musician's instrument may be quite valuable such that he/she will not want to glue anything onto it, thereby decreasing its value. Furthermore, Lester's device is expensive since it must be customized to fit the exact shape and size of the guitar back. Even further, Lester's device is bulky enough that it would likely require a modified or new instrument case to accommodate it.

U.S. Pat. No. 5,000,071 to Thomas (1991), discloses a guitar holder for securing a musical instrument to a waist belt. The apparatus includes a first anchor (17) for being attached to the waist belt; a second anchor (45) for being attached to the musical instrument; and securing structure for removably securing the first anchor to the second anchor. As for Lester's device, a downside is that the second anchor (a protruding flat loop) is permanently attached (33, 39, 41) to the guitar back, thereby being unsightly as well as damaging to the guitar's value, and perhaps also the sound quality (especially for acoustic guitars), and also would require modification or replacement of the guitar case. Another disadvantage is the first anchor which is a rather unsightly construction of metal rods that extends both upward and downward from the belt at the front of the musician's pants (see Thomas' FIG. 9). Since this first anchor cannot be removed except by unfastening the musician's belt, it will be distractingly visible when the musician does not have the guitar mounted on it, and also it would appear to interfere with bending at the waist for sitting.

In U.S. Pat. No. 3,833,751 to Chapman (1973), a type of electric guitar is shown which uses a belt-hook similar to that of Lester as the primary weight-bearing support. A small, non-weight-bearing strap that passes around the musician's torso under one arm and over the opposite shoulder attaches near the instrument's tuner head to provide vertical stability. An apparent disadvantage is that the instrument must be donned or removed in two steps—first the belt-hook is positioned, and then the strap is put on and positioned. Furthermore, this upper strap can interfere with the performer's costume, and also may not be comfortable to female musicians. Finally, the belt-hook assembly positions the base of the instrument in such a way that it can interfere with most types of seating if the musician is attempting to play while seated.

In U.S. Pat. No. 5,069,103 to Healy (1991), a belt-hook assembly (37) is attached to the rear surface of the body of an instrument, and the musician wears a belt assembly (11) to which is fastened a depending strap segment (23) which interconnects (e.g., buckles 35*a*, 35*b*) to a second strap segment (29) that is attached to the base of the instrument's body. Although the belt hook is easily unhooked, the buckle is not since it would take both hands to buckle, thereby making instrument changes awkward and slower. Also the attachments to the instrument would devalue an expensive instrument as well as its instrument case. In U.S. Pat. No. 3,037,416 to Cunningham (1962) similar but perhaps even greater disadvantages are apparent for a strap (14) that clips (28) onto a pants belt and attaches to the guitar with a clasp (42) that engages with a screw eye (50) that is screwed into the front face of the guitar, thereby not only detracting from appearance and value, but also possibly affecting acoustics and even structurally weakening the guitar.

U.S. Pat. No. 4,310,111 to Brent (1982) addresses the issue of shoulder, neck, back and arm strain by again using a belt (2) for bearing the weight of the musical instrument (10, e.g., guitar) on the hips, plus two-point connection between the belt and the guitar. On the front of the belt is an attachment plate (7) containing two slotted sockets (8 and 9). The guitar also has a support plate (11) held in place upon the back of the instrument by screws or bolts (12). The support plate contains two attachment bolts (13 and 15). The instrument then is held fast against the player by attaching the support plate (11) to the attachment plate (7). This is done by first sliding the adjustable bolt (13) into the slot of an elongated horizontal socket (8), and then placing the stationary bolt (15) into the vertical socket (9), and the bolt may be locked into place by placing a flexible securing loop (16) over the top of the slot in socket (9) and beneath a latch (17). All of this appears to be rather tedious to put together, and doesn't allow for easy transition from standing to sitting or even to walking while playing (since the guitar is held close to the body and also because of a leg strap). Also the screw-attached plate would be quite detrimental to instrument value as well as requiring a modified instrument case. Furthermore, as seen in Rachel Brent's FIG. 1, the belt with attachment plate rests on the front of the zipper area and includes a second strap (5) that passes around the inside of the thigh through the crotch. Not only is this unsightly, but likely very uncomfortable for a male musician.

Accordingly, an object of the present invention is to provide method and apparatus to support a guitar or other similar instruments while overcoming defects of the prior art. In particular, it is an object to overcome the problems of stress on the neck, shoulder, and back of a user of the instrument (e.g., a musician).

Additional objects are to provide support apparatus which is relatively inexpensive, familiar to musicians, quick to don or remove, and does not interfere with a performer's costume.

Further objects include providing an easy way to adjust the height and angle of the supported instrument.

Even further, performances on stage should not be hindered. The support should easily be detached and reattached to another guitar. It should allow use (e.g., playing) of the instrument while standing, sitting, walking, gyrating, and while transitioning between these modes of play.

Even further, it is an object to provide the support but not damage or even mar the appearance of the instrument or affect its acoustics. Therefore there shouldn't be any permanent modifications to the material or shape of the guitar (e.g., by screwing something extra onto the back, e.g., by gluing something on), and preferably there should not be additions to the instrument that would require modification of the instrument's case. Thus the value of the instrument (and its case) will not decrease, and the tone quality will not be compromised.

BRIEF SUMMARY OF THE INVENTION

According to the invention a support structure for an instrument is disclosed whereby the instrument can be supported by the lower body of a user of the instrument while the instrument is being used, the support structure comprising: a patch of a releasably adhering fabric that is attached to a back of the instrument; and a hanger that is removably attachable to the user's lower body, the hanger comprising a releasably adhering fabric that will mate with the releasably adhering fabric of the patch on the instrument.

According to the invention the support structure is such that the patch attachment to the instrument back is removable.

According to the invention the support structure is such that the patch is attached to a removable and replaceable component of the instrument.

According to the invention the support structure is such that the removable attachment of the hanger to the user's lower body comprises attachment to apparel worn on the user's lower body. Preferably the hanger comprises releasably adhering fabric that is permanently attached to, or made as a part of, the apparel. Alternatively the hanger further comprises a loop of material that hangs from a belt type of apparel. Alternatively the hanger further comprises a rigid material that is removably or permanently attached to, or made a part of, a belt type of apparel. A preferred embodiment of the rigid hanger is such that it positions the releasably adhering fabric above the level of the belt.

According to the invention the support structure is such that the instrument is a musical instrument normally supported by a conventional strap that places the instrument's weight upon the neck and/or shoulder of the user; and the support structure supplements the conventional strap.

According to the invention the support structure is such that the releasably adhering fabric is a hook/loop fabric.

According to the invention a method is disclosed for supporting an instrument while it is being used such that the instrument's weight is mostly bourn by the lower body of the instrument user due to a removable attachment of the instrument to apparel worn on the lower body, and wherein the removable attachment can be attached or removed while the instrument is being used, the method comprising the steps of: attaching a patch of a releasably adhering fabric to a back of the instrument; attaching a hanger to the apparel, the hanger comprising a releasably adhering fabric that will mate with the releasably adhering fabric of the patch on the instrument; supporting the instrument by mating the releasably adhering fabric of the hanger with that of the patch, wherein the mating is accomplished when the two fabrics are pressed together as the user presses the instrument against the apparel on the user's body; and removing support for the instrument by pulling the releasably adhering fabric of the hanger apart from that of the patch, wherein the pulling apart is accomplished by the user pulling the instrument away from the apparel on the user's body.

According to the invention the method further comprises the step of removably attaching the patch to the instrument back.

According to the invention the method further comprises the step of attaching the patch to a removable and replaceable component of the instrument.

According to the invention the step of attaching the hanger to the apparel further comprises permanently attaching the releasably adhering fabric of the hanger to the apparel, or making the releasably adhering fabric as a part of the apparel.

According to the invention the step of attaching the hanger to the apparel further comprises hanging a loop of material from a belt type of apparel; and attaching the releasably adhering fabric of the hanger to the material. Preferably the method further comprises the step of making the loop of material adjustable in length.

According to the invention the step of attaching the hanger to the apparel further comprises: removably or permanently attaching a rigid material to, or making a part of, a belt type of apparel; and attaching the releasably adhering fabric of the hanger to the rigid material. Preferably the method further comprises the step of forming the hanger such that it positions the releasably adhering fabric above the level of the belt.

According to the invention, wherein the instrument is a musical instrument normally supported by a conventional strap that places the instrument's weight upon the neck and/or shoulder of the user, the method further comprises the step of using a conventional strap to supplement the method for supporting the instrument.

According to the invention, the releasably adhering fabric is preferably a hook/loop fabric.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 1:
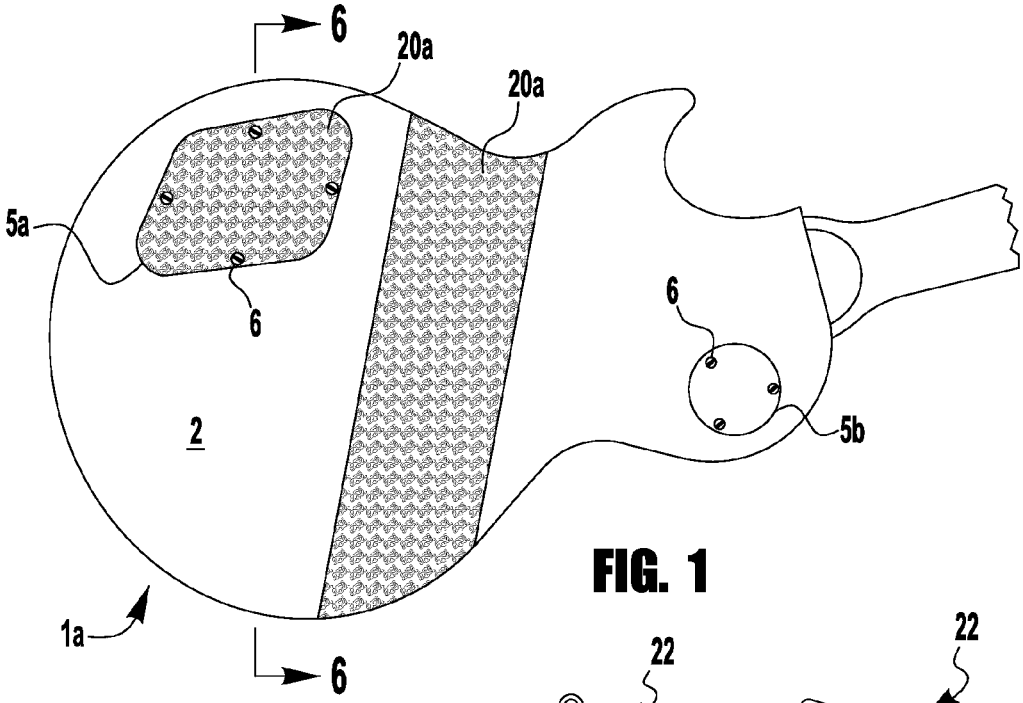
Figure 2:
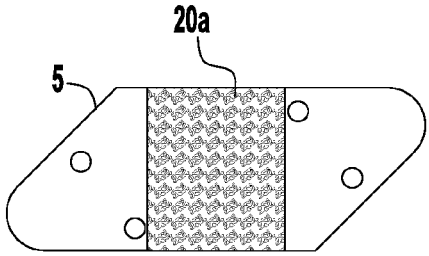
Figure 2A:
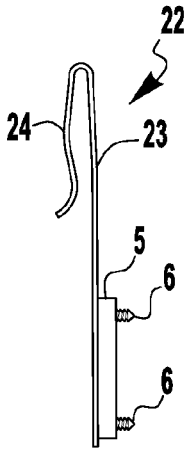
Figure 2B:
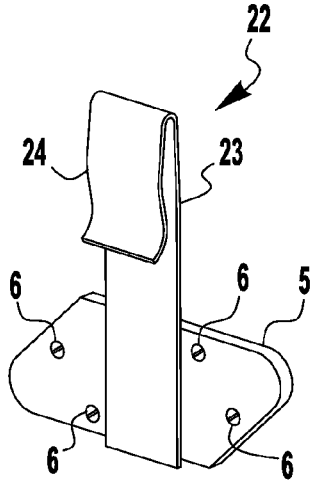
Figure 3:
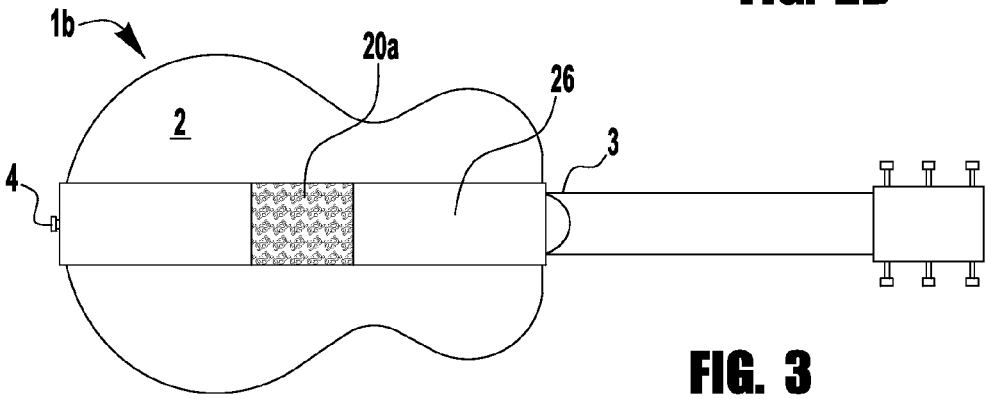
Figure 5:
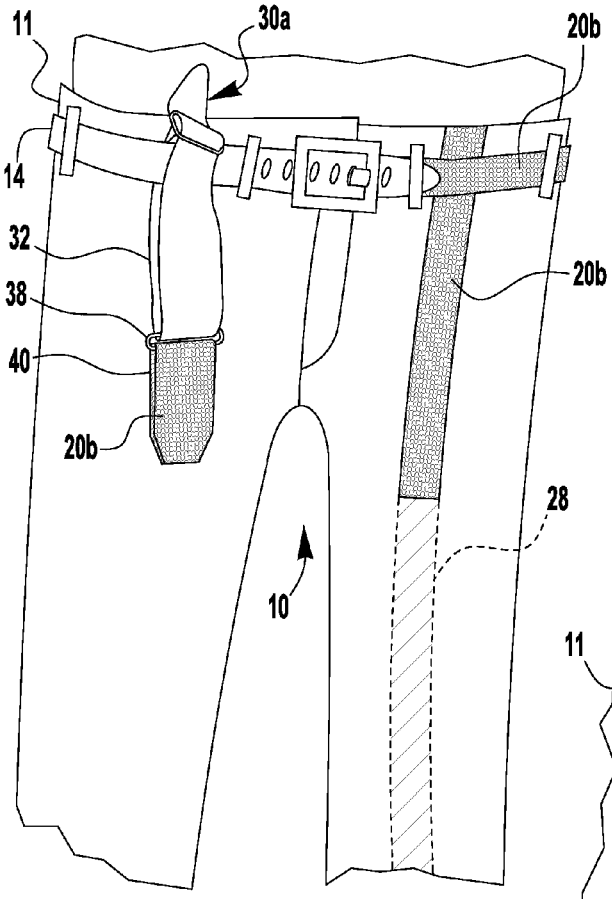
Figure 4:
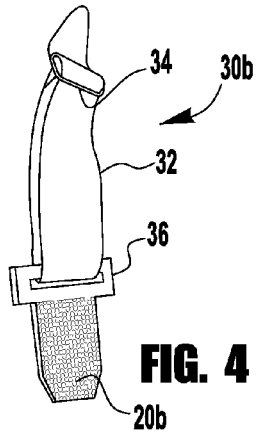
Figure 6:
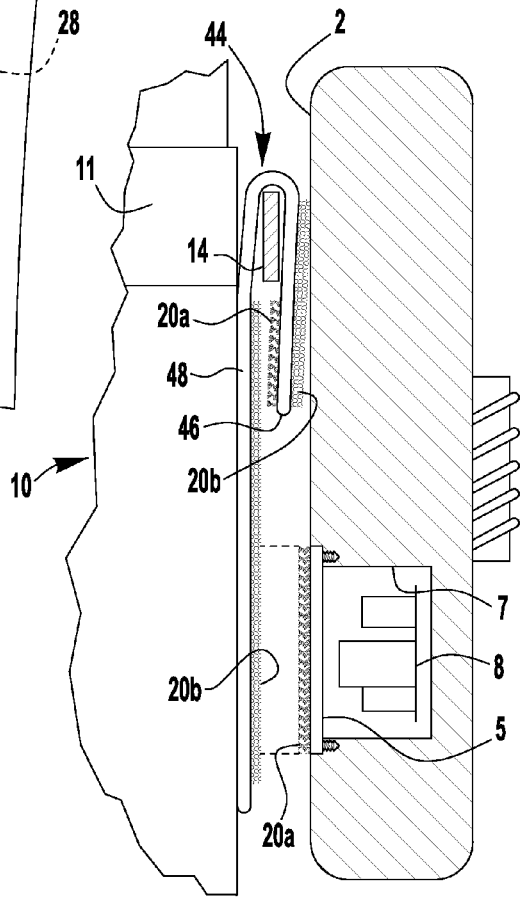
Figure 7:
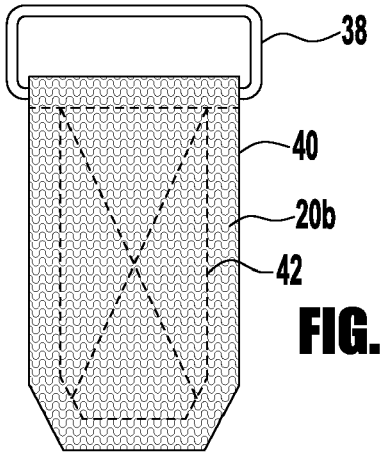
Figure 8:
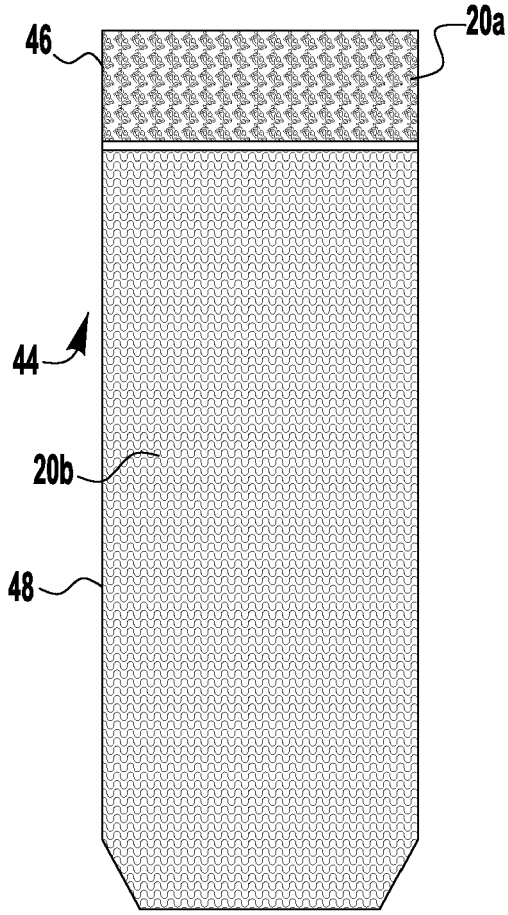
Figure 9:
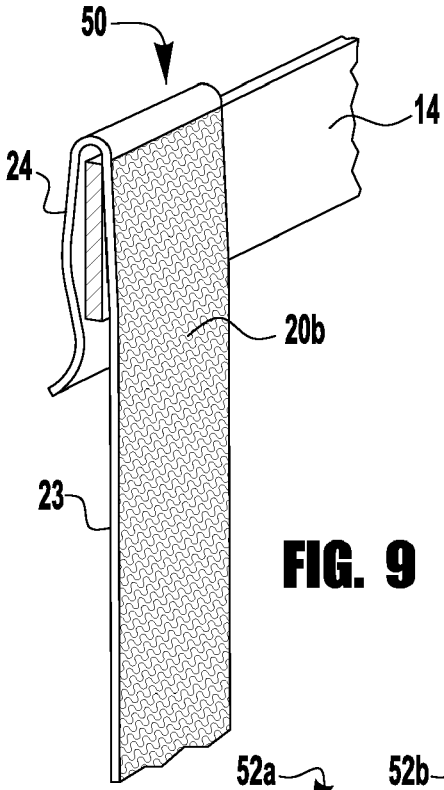
Figure 10:
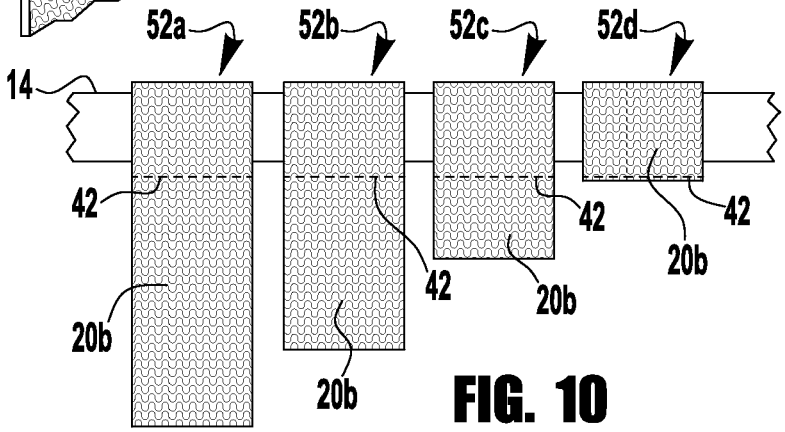
Figure 11A:
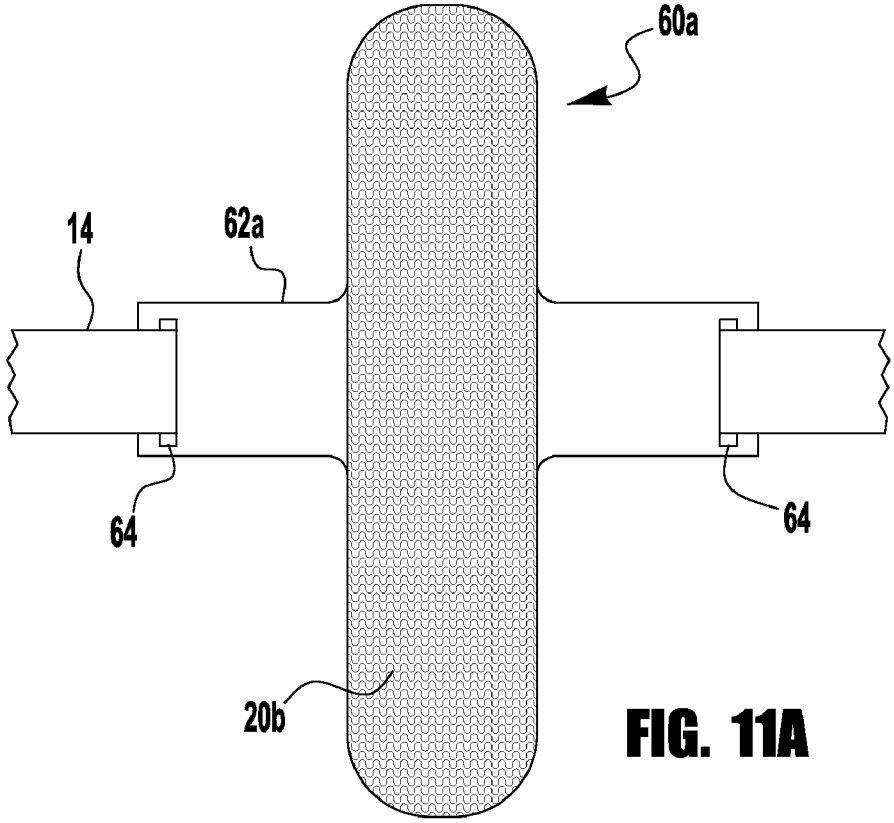
Figure 11B:
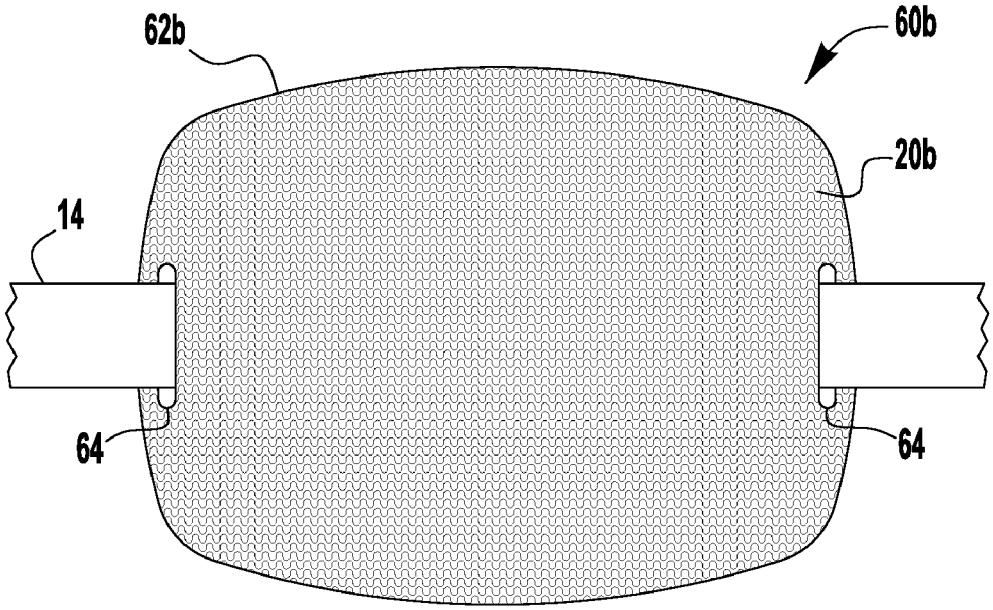

The structure, operation, and advantages of the present preferred embodiment of the invention will become further apparent upon consideration of the following description taken in conjunction with the accompanying drawings, wherein:

FIG. 1 is a back view of an instrument that has a patch attached thereon according to the invention;

FIG. 2 is a cover plate component of the instrument of FIG. 1 wherein the cover plate is partly covered by a patch according to the invention;

FIGS. 2A and 2B are edge and perspective views of a cover plate combined with a belt clip hanger according to the invention;

FIG. 3 is a back view of another type of instrument that has a patch attached thereon according to the invention;

FIG. 4 is a perspective view of a slide adjustable hanger strap with a one piece tab according to the invention;

FIG. 5 is a front view of a belted pair of pants with several different forms of hangers attached thereon according to the invention;

FIG. 6 is a side cross-sectional view of the instrument body taken along the line 6-6 in FIG. 1, plus a side view of a cutout portion of the pants and belt of FIG. 5 with a one-piece hanger on the belt and a mating patch on the instrument, all according to the invention;

FIG. 7 is a front view of a variant tab portion for hanging from the slide adjustable hanger strap of FIGS. 4 and 5 according to the invention;

FIG. 8 is a front view of an opened one-piece hanger like the one in FIG. 6, according to the invention;

FIG. 9 is a perspective view of a clip-on hanger that is clipped onto a cross-sectioned portion of a belt according to the invention;

FIG. 10 is a front view of fixed length hangers shown in several different exemplary lengths according to the invention; and FIGS. 11A and 11B are front views of two exemplary shapes of rigid elevated hangers according to the invention.

DETAILED DESCRIPTION OF THE INVENTION

Among the terms used herein is "hook and loop fabric" or "hook/loop fabric" or "Velcro" and/or other similar terms. These terms are used interchangeably and should be understood to refer generically to any type of releasably self-adhering material (not necessarily even fabric), such as the material known by the registered trade name of Velcro®, wherein a first portion of the material releasably interlocks with a second portion of the material when they are pressed or otherwise mated together. The first and second portions are generally, but not always, different in a complementary, interlocking way (e.g., a "hook" material and a corresponding or mating "loop" material. The interlocking type of adherence between the first and second portions is releasable, typically by simply peeling them apart, and can be repeatably interlocked and released many times. The interlocked first and second portions have the most "adherence" strength in the shear direction. The term "hook/loop fabric" should be understood to refer to either one of the mating portions of the hook and loop material. The term fabric is used since the preferred embodiment is a flexible but non-extensible material. The invention is not limited to flexible fabric, so the term fabric is intended to mean any type of material, even possibly rigid. For example, a piece of sheet metal with a releasable adhesive coating on a surface is included in the scope of the term hook/loop fabric, or releasably-adhering fabric/material.

A preferred embodiment of the present invention is an auxiliary or supplementary support structure (apparatus, device) for removably attaching the back of an instrument, particularly a musical instrument, most particularly a guitar in any form, to a person's lower body, e.g., the waist or below, thereby transferring the majority of the instrument's weight from the shoulder/neck/back of the upper body to the waist/hips/thighs/pelvis/legs etc. of the lower body. A corresponding attachment and support method provided by the subject support structure is also claimed, thus references herein to the inventive support, support structure, apparatus, device, and the like are also considered references to the corresponding method of support. Preferably the invention supplements a standard guitar strap which is still used as a safety backup and as a measure to prevent the guitar from tilting forward, however the inventive support could be used as the only support of the instrument if the user so desires. It should be understood that the primary intended use of the invention is for supporting a musical instrument (particularly a guitar, most particularly an electric guitar) while the user (musician) is playing the instrument, especially when the user is standing while playing. Besides transferring weight away from the user's upper body, another advantage is that the inventive supplementary support frees up the hand doing the string fingering making it easier to play, and even possibly enabling better performance by the guitar player. By removing the weight from the shoulder/neck area, the upper arm and therefore the whole arm is more relaxed and freed up so that more expansive fingering becomes easier. For example, the fingering hand can be rotated around the guitar neck in a way that allows finger positions with a greater span. For example, the more relaxed arm is freed to perform more complicated and faster-moving fingering changes. Thus, in addition to its other advantages, the inventive support brings the advantages of playing while sitting (with the guitar resting in the lap) to the player while he/she is standing.

The invention will be described with reference to an electric guitar as a preferred embodiment, but this should not be considered limiting the invention's scope to a particular type of guitar, or to use only with guitars. For example, an electric bass guitar ("bass") is a particularly heavy type of guitar for which the invention is especially suitable and desirable. For example, an acoustic guitar, banjo, etc. are not as heavy, but the invention can still be adapted for use with these lighter instruments. For example, a saxophone is often supported by a strap that encircles the player's neck; the invention can advantageously be applied to non-guitar instruments such as the saxophone. By extension, the inventive support structure can be used to support any type of "instrument", musical or otherwise, wherein the instrument can be supported by (suspended from) the lower body of a user of the instrument while the instrument is being used. The inventive support structure (apparatus) functions according to the inventive support method of providing a removable attachment of the instrument to the lower body of the user, by removably attaching the instrument to the user's apparel that is worn on (i.e., removably attached to) a lower part of the body, e.g., pants or a skirt and/or a belt around the waist and/or hips. Thus the generic "instrument" and its "user" are interchangeably referred to in terms relevant to the preferred embodiment that is illustrated herein, i.e., a musical instrument (particularly an electric guitar), and a musician/performer who is the user.

General Form

Referring now to FIGS. 1-3 and 6, according to the inventive support method one side of a hook/loop fabric pair (e.g., Velcro®) 20*a*/20*b* (collectively referred to as hook/loop fabric 20) is attached to the back 2 of an instrument which in this example is a guitar 1, preferably the hook fabric 20*a*. A preferred embodiment is shown in FIG. 1 wherein the back 2 of an electric guitar 1*a* is illustrated. FIG. 3 shows the back 2 of an acoustic guitar 1*b*. A side cross-sectional view of the electric guitar 1*a* is also shown in FIG. 6. Electric guitars 1*a* generally have one or more compartments 7 (FIG. 6) cut into the back of the guitar body 2, for example to house electronic components 8. The compartment 7 is covered, typically with a plastic or metal cover plate 5 held on by several screws 6. To prevent damage to the finish (e.g., varnished wood), a patch of the hook fabric 20*a* (for example) is preferably adhered onto one of the compartment cover plates 5 rather than on the varnished wood. Another advantage of this form of attachment is that cover plates 5 can be manufactured with the hook/loop fabric 20 already applied, and can then be sold separately for aftermarket application to the back of a guitar 1. This provides a means of upgrading old guitars 1, and also enables simple replacement of the cover 5 if the hook/loop fabric 20 becomes worn out.

Preferably the largest and most conveniently placed cover plate 5 is used for hook/loop fabric 20 attachment. Alternatively, sheets of hook/loop fabric 20 can be provided with pre-applied adhesive backing covered by a protective slip sheet. The sheet of hook/loop fabric 20 is preferably supplied as precut for application to the cover plate 5, or it can be generically shaped and cut to size by the purchaser. In order to hold the weight of the guitar 1, the area of overlap between a Velcro 20 covered hanger (e.g., strap 30*b* in FIG. 4) and the Velcro 20 patch on the guitar 1 is preferably approximately in the range of 2 to 4 square inches, and even more is better. Therefore the hook/loop fabric 20 preferably covers the entire area of the largest cover plate 5, as shown in FIG. 1. Even more area can be obtained by extending the hook/loop fabric 20 beyond the perimeter of the cover plate 5, but only adhering it to the cover plate 5. Of course the hook/loop fabric 20 could be adhered to a smaller portion of the cover plate 5 as shown in FIG. 2, thereby allowing convenient use of readily available ribbon-like strips of the hook/loop fabric 20, preferably supplied with adhesive backing, although non-adhesive backed hook/loop fabric 20 could also be adhered with a separate adhesive such as epoxy, for example. Other cover plates 6 in other shapes can also be used as the cover plate to which the hook/loop fabric 20 is attached.

In the case of an acoustic guitar 1*b*, as shown in FIG. 3, or any such instrument not having cover plates 5, 6, the hook/loop fabric 20 patch can be non-permanently provided on the back of the body 2 by, for example, attaching it to a harness-like attachable strap 26 wherein the attachable strap 26 extends from end to end of the instrument body 2 and is attached to a strap peg 4 and a neck 3 of the instrument 1, for example where the neck 3 joins the body 2. Of course the attachable strap 26 can be formed from any convenient material including, for example, cloth, leather and plastic and will likely include one or more lengths of cord or narrow strap for tying the attachable strap 26 onto the instrument 1. Alternatively, the attachable strap 26 can be, for example, extended from side to side of the instrument body 2 and held in place by tensioned hooks or clamps (not shown, but known in the art). Given this teaching, many attachable strap 26 variations will now be apparent to those in the related arts, all of which are intended to be within the scope of the present invention.

Finally, in those cases wherein the instrument user and/or owner is not concerned about possible detriment to the value of the instrument, the patch of hook/loop fabric 20 can be directly adhered to the back of the instrument body 2 as exemplified by the diagonal strip in FIG. 1. It may be noted that this arrangement allows for greater flexibility in positioning the guitar 1 relative to the body of the musician/user.

Referring now to FIGS. 4-11B, the mating portion of the hook/loop fabric 20 pair (preferably loop fabric 20*b*) is removably attached to the waist/hips of the user, generally indirectly through attachment to clothing (e.g., pants 10, waistband 11, and/or belt 14 as shown in FIGS. 5-6), the clothing being removably "attached" to the user by conventional means, of course. Loop fabric 20*b* is preferred since it generally has a softer surface than the hook fabric 20*a*, therefore it is least likely to mar the back surface 2 of the instrument 1. Examples of removable attachment methods include, but are not limited to, the following general list. (Appropriate details will be presented further below.)

- Hang from a belt 14 around the user's waist using a loop of material 32 around the belt 14 (left side of FIG. 5). Vertical height adjustment can be achieved by making the loop adjustable in size.
- Hang from a belt 14 around the user's waist using a length of hook/loop fabric 20 that loops around the belt 14 and extends downward. Vertical height adjustment can be achieved by adjusting the length of the downward extension and/or by adjusting the point of removable attachment between the hook/loop fabric 20 hanging from the belt 14 and the mating portion of hook/loop fabric 20 on the back 2 of the instrument 1 (FIG. 6).
- Hang from a belt 14 and/or a waistband 11 of pants/skirt 10 by an inverted J-hook 50 (FIG. 9).
- Hook/loop fabric 20 (e.g., loop fabric 20*b*) is part of, e.g., sewn onto, the front of a belt 14 that can be fastened around the user's hips/waist/lower torso (right side of belt in FIG. 5).
- Hook/loop fabric 20 (e.g., loop fabric 20*b*) is part of, e.g., sewn onto, the front of pants 10 (right side of FIG. 5), or analogously to a skirt or other clothing apparel. For appearance sake, the hook/loop fabric 20 is optionally part of a stripe 28 or a decoratively shaped appliqué/patch 28 on the pants/skirt 10 front.
- Hook/loop fabric 20 (e.g., loop fabric 20*b*) is part of, e.g., adhered onto, a rigid (e.g., metal) or semi-rigid (e.g., plastic) hanger 60 that is attached to a belt 14 and extends at least upward for the purpose of removably attaching the guitar 1 in an elevated playing position as utilized by some musicians (FIGS. 11A-11B).
- Any method of removably attaching the hook/loop fabric 20 to the user's body in a way that places the weight of the instrument 1 on the lower part of the user's body (e.g., hips, thigh, lower torso, waist, etc.) rather than on the upper part (shoulder, arm, neck, head).

In general, the inventive support apparatus should not mar the instrument surface 2. Preferably it does not detract significantly from the user's appearance, and most preferably enhances it (e.g., with a decorative form of hanger such as, for example a stripe 28). It is notable that the inventive method of attaching one portion of releasably adhering material (e.g., hook fabric 20*a*) to the instrument 1, and removably attaching a second, mating, portion of releasably adhering material (e.g., loop fabric 20*b*) to the lower part of the user's body (e.g., a belt 14 fastened around the waist); enables fast and easy attachment and detachment of the instrument 1 to/from the user's body. For example, attachment is a simple matter of pressing the guitar 1 against the front of the musician at the desired height (e.g., Velcro stripe 28 on pants 10). Likewise, detachment is again a simple matter of peeling the guitar 1 off the musician—slap it on, rip it off! This can be done while playing since there is no operation of clasps and the like. Also this can be done while performing, in order to enable any kind of gyrations desired, and/or to enable transitioning between standing and sitting playing positions. The inventive method generally assumes that an instrument 1 like a guitar 1*a*, 1*b* will be detached from the body while the musician is playing in a sitting position wherein the instrument 1 can instead be supported in the lap of the sitting player. An exception to this assumption may apply in the case where the musician attaches the guitar 1 up high enough to place it above the lap when sitting (e.g., using a rigid elevated hanger 60 as shown in FIGS. 11A and 11B).

Specifics

The area of mating overlap of the hook fabric 20*a* with the loop fabric 20*b* will be determined for holding the weight of the instrument 1, wherein larger overlap areas will support heavier instrument weights. For example, an 8 square inch (2×4) overlap could be used. For example, a two inch horizontal width hook fabric patch 20*a* on the instrument back 2 overlaps a two inch wide vertical loop fabric strip 20*b* hanging from a belt 14. This allows for variable vertical positioning of the instrument 1 as desired, with an invariable 4 square inch overlap.

Various embodiments of apparatus to carry out the inventive method are disclosed herein. Different embodiments are contemplated in order to meet different needs of users (e.g., musicians) having different clothing and playing styles. For example, hook/loop fabric 20 that is directly attached to the pants/skirt 10 or to the belt 14 will hold the guitar 1 close against the body. For example, a musician wanting more freedom of movement (e.g., for walking while playing) may prefer a flexible strap (e.g., 30, 44) that hangs from the belt 14. For example, a musician wanting to position the guitar 1 above the belt 14 will need some type of at least semi-rigid hanger that positions and adequately supports the hook/loop fabric 20 above the belt 14 (e.g., hangers 60*a*, 60*b*).

It is notable that although the abovedescribed apparatus embodiments are ideal for transferring the instrument weight from the shoulder/neck/back to the waist/hips/lower torso, there are added benefits that could very well meet other needs of instrument users even if they don't need to take weight off of their shoulder/neck/back. For example, the fast and simple attachment characteristics themselves are very desirable, especially for those who want to move and/or gyrate while playing. For example, the fast and simple attachment characteristics also provide a quick way to change instruments during a performance. Therefore, for players like these who do not care about weight distribution, the inventive method could be extended, for example, to attaching the hook/loop fabric 20 to a shirt/vest/suspender front.

In addition, FIGS. 2A-2B illustrate a different method for implementing many of the present invention's objects, most particularly that of not making any permanent changes to the instrument (e.g., electric guitar 1*a*) that would devalue it. Although the prior art already discloses belt hooks that are attached to the guitar back 2 (e.g., Lester '570), a hanger plate 22 as shown in FIGS. 2A-2B has the belt hook permanently attached only to the removable and easily replaceable cover plate 5. A long leg 23 (strap) of suitable length is folded over at the top to form a belt clip 24 type of inverted J-hook for hooking over a belt 14 and/or waistband 11. The long leg 23 is affixed or otherwise made part of the cover plate 5. Thus the support structure is made as a single piece wherein the removable attachment to the body of the user becomes the belt clip 24 which is easily slipped on or off of the user's belt 14 and/or waistband 11. The hanger plate 22 can of course take many forms allowing for the use of different materials including, for example, plastic, leather, canvas, etc.; and optionally including various means for adjusting the length of the strap 23. The hanger plate 22 can be made, for example, entirely of molded plastic; or for example, of a spring-steel strip 23, 24 welded or glued to a metal or plastic cover plate 5.

FIGS. 4-9 illustrate a variety of exemplary embodiments of a strap that hangs from the belt 14 to provide a suitably positioned portion of hook/loop fabric 20. Given the teachings of these examples other variations and functional equivalents will no doubt become apparent to one of ordinary skill in the relevant arts, and all such variants and equivalents are intended to be included within the scope of the present invention.

FIG. 4 shows a slide-adjustable strap 30*b* wherein a soft surfaced fabric strap 32 (e.g., 2 inch wide flat woven strap material) is looped back on itself and fed through an adjustable slider 34 such as is commonly used to adjust the length of a strap. Preferably the slider 34 is made of soft plastic and/or is covered with a soft material so that it will not scratch the guitar back 2. A one piece tab 36 (e.g., leather or plastic) hangs from the strap 32 and has an outer face covered with hook/loop fabric 20 (preferably loop fabric 20*b*) that is, for example, glued on. As shown in FIG. 5, the belt 14 is passed through the looped fabric strap 32 in order to attach the slide-adjustable strap 30*a*, 30*b* (collectively referred to as 30).

FIG. 5 shows a second slide-adjustable strap 30*a* that has, for example, the same adjustable length strap 32 as the first slide-adjustable strap 30*b*, but a slightly different hanging tab 40 that can also be seen in FIG. 7. The second tab 40 is made of a flexible but non-extensible material (e.g., woven nylon cloth) that is wrapped around a ring 38 at the top. In FIG. 5 the tab material is glued together around the ring 38, and in FIG. 7 it is sewn together using stitches 42. Preferably the tab 40 is made using only a ribbon of loop fabric 20*b* rather than adhering the hook/loop fabric 20 to another tab material.

FIGS. 6 and 8 show a one-piece embodiment of a hanging strap 44 wherein a long strip of fabric (e.g., hook/loop fabric 20) has loop fabric 20*b* facing outward from a long bottom portion 48 and a short length of hook fabric 20*a* on the same face of a top portion 46 of the hanging strap 44 (e.g., sewn on top of the loop fabric 20*b*). Obviously this could also be constructed from a piece of fabric (plastic or metal but preferably cloth) having portions of hook or loop fabric 20 affixed on it. As shown in FIG. 6 the one-piece hanging strap 44 can be removably attached to the belt 14 by folding the top portion 46 over the belt 14 such that the hook fabric 20*a* on the top portion 46 mates with the loop fabric 20*b* on the bottom portion 48. The length of the hanging strap 44 is adjusted by pulling the top portion 46 as far down as needed before mating it to the bottom portion 48. The instrument (e.g., electric guitar 1 as shown) is, for example, simply and quickly removably attached to the hanging strap 44 by pressing the hook fabric 20*a* that is adhered to the cover plate 5 against the loop fabric 20*b* anywhere on the hanging strap 44. Particularly if, as shown in FIG. 6, an extra portion of loop fabric 20*b* is attached to the outside face of the folded over top portion 46 then the hanging strap 44 could be left at a fixed length and the back 2 of the instrument can be removably attached to the hanging strap 44 at any desired height within the range of the strap length simply by pressing the instrument's hook/loop fabric 20 against the strap's mating hook/loop fabric 20 at the desired height.

FIG. 10 shows a simplified embodiment of a one-piece hanging strap. The simplified strap 52 is shown in several lengths (e.g., straps 52*a*, 52*b*, 52*c*, 52*d*) from the longest simplified strap 52*a* to the shortest simplified strap 52*d*. This could be marketed in a variety of fixed lengths, say in one inch increments. A top portion of the simplified strap 52 is folded over backwards (away from the outward facing side of the strap 52) to form a loop of sufficient size for passing a belt 14 therethrough, and then the end of the folded-over portion is attached (e.g., by stitches 42) to the rest of the simplified strap 52. This construction enables a removable attachment of the simplified strap 52 to the belt 14. At least the outward facing side is covered with hook/loop fabric 20, preferably loop fabric 20*b* as shown, for the reasons stated above. Again, this simplified strap 52 could be constructed from a piece of fabric (e.g., cloth, plastic or metal) having hook/loop fabric 20 affixed on it, but is most simply made by folding and sewing a ribbon of hook/loop fabric 20 (e.g., loop fabric 20*b*). If a rigid (including semi-rigid) hanging strap is desired, then the simplified strap 52 could be made from metal or plastic sheet material with affixed hook/loop fabric 20. Of course the stitching 42 would likely be a more suitable joinder form than sewing, for example welding.

FIG. 9 shows a variant embodiment of a rigid hanging strap, a clip-on hanger 50. A long leg 23 (strap) of suitable length is folded over at the top to form a belt clip 24 type of inverted J-hook for hooking over a belt 14 and/or waistband 11. The long leg 23 is covered on the outward face by hook/loop fabric 20 (preferably loop fabric 20*b*) adhered to it. The clip-on hanger 50 can be made, for example, entirely of molded or formed plastic (completely rigid or semi-rigid); or for example, of a spring-steel strip 23, 24. This construction enables a removable attachment of the clip-on hanger 50 to the belt 14 and/or the waistband 11.

FIGS. 11A-11B show an embodiment wherein the hanger is an elevated hanger 60, shown in two exemplary shapes: narrow (60*a*) and wide (60*b*). The elevated hanger 60 is made from a rigid (including semi-rigid, e.g., plastic, metal) backing material 62*a*, 62*b* (collectively referred to as backing 62) that is attachable to a belt 14, that extends at least upward from the belt level, and is at least partially covered (on an outward face) with hook/loop fabric 20 (preferably loop fabric 20*b*). Preferably the belt attachment points (e.g., slits 64) are spaced apart far enough to prevent the weight of an attached instrument 1 from twisting the elevated hanger 60. The elevated hanger 60 can be formed in any shape that meets these basic criteria. This allows for creativity in design for appearance.

Twisting is herein defined as rotation about an axis that is normal to the plane of the belt 14, and includes such rotation when the backing 62 buckles or otherwise doesn't remain in a flat planar shape. Twisting moments will be present when, for example, a guitar 1 is removably attached to the elevated hanger 60 horizontally off center and/or to a hook/loop fabric patch 20 on the guitar back 2 that is not positioned at the center of gravity of the guitar 1. Of course it is well known that, because of the long neck 3 ending in a tuning head, a typical guitar 1 is not likely to be supported at its center of gravity; therefore the musician's fingering hand generally has to also support some of the offset weight that tends to twist the neck 3 downward. Thus an advantage of a guitar hanger that can hold against this twisting moment is that it frees the fingering hand from weight bearing and the musician can therefore creatively adopt other fingering positions and methods, and will be able to play longer and possibly better due to reduced fatigue of the hand, arm and shoulder muscles.

Several of the inventive hangers that are in a fairly rigid form and are suitably attached to a belt 14 will have this advantage, for example the one-piece hanging strap 44 and the simplified strap 52 when made with a rigid material and when extended widely enough along the belt 14, and especially the elevated hanger 60. Of course the attachments 42, 64 must be relatively close fitting to the belt 14, and the belt 14 itself must be twist resistant, for example by being wide and/or made from a relatively stiff material (e.g., thick leather). One way to accomplish the desired belt attachment points that are "spaced apart far enough" is to incorporate the belt 14 in the hanger, for example by permanently attaching the two together; for example by making the belt and hanger out of a single piece of material. It should be well within the capability of a design engineer of ordinary skill to determine sufficient belt attachment point spacing without undue experimentation.

In FIG. 11A an exemplary embodiment of a "narrow" elevated hanger 60*a* is shown wherein the rigid backing 62*a* is shaped in the form of a cross having relatively narrow (e.g., approximately 2 inch wide) vertical legs that extend upward and downward from a belt level, and having horizontal arms that extend rightward and leftward far enough to space apart the belt slits 64 (attachment points) a distance sufficient to prevent twisting. The vertical legs are covered with an adhered layer of hook/loop fabric 20 (preferably loop fabric 20*b*), for example using a commercially available width ribbon of adhesive backed hook/loop fabric 20. The vertical leg that extends downward from the belt level is optional as is covering it. The downward leg could provide better leverage for preventing the upper leg from bending forward, but may also interfere with the user's bending to sit down.

In FIG. 11B an exemplary embodiment of a "wide" elevated hanger 60*b* is shown wherein the rigid backing 62*b* is shaped in the form of a wide oblong that extends upward and downward from a belt level, and also extends rightward and leftward far enough to space apart the belt slits 64 (attachment points) a distance sufficient to prevent twisting. As much as the entire outer surface of the backing 62*b* is covered with an adhered layer of hook/loop fabric 20 (preferably loop fabric 20*b*), for example using a commercially available sheet of adhesive backed hook/loop fabric 20 that is cut to fit. The portion that extends downward from the belt level is optional as is covering it. Of course less than the entire surface area can be covered as desired. The downward portion could provide better leverage for preventing the upper portion from bending forward, but may also interfere with the user's bending to sit down.

CONCLUSION

Method and apparatus have been described for supporting an instrument 1, particularly support that places as much as possible of the instrument weight onto the instrument user's waist/hips/thighs. Example embodiments have been described with reference to a common need for such support of a guitar 1, particularly an electric guitar 1*a* which tends to be heavier than acoustic guitars 1*b*, banjos, etc. The inventive support can be used alone but is probably better used in conjunction with a traditional guitar strap which will function both as a safety backup and a means to help prevent the guitar from falling forward. It can be seen that the inventive support will substantially reduce the weight of the guitar on the musician's upper shoulder/neck area as well as weight on the back itself.

A patch (FIGS. 1, 2, 3, 6) of a releasably adhering fabric (e.g., hook/loop fabric 20) is attached to the back 2 of the instrument 1. The attachment may be temporary (e.g., attachable strap 26 in FIG. 3) or permanent (FIGS. 1, 2). If permanent, then preferably the permanent attachment is made to a removable and replaceable component (e.g., a cover plate 5). A hanger (e.g., straps 30, 44, 52, a clip-on 50 and an elevated hanger 60) that is removably attachable to the user's waist/hips/thighs is at least partially covered by a releasably adhering fabric (e.g., hook/loop fabric 20) that will mate with (releasably adhere to) the fabric patch 20 on the instrument 1. Examples of "removable attachment" to the user's waist/hips/thighs include, for example, a belt 14 passing through or made part of hanger straps 30, 44, 52 or an elevated hanger 60; a clip-on hanger 50 clipped on a waistband 11 and/or a belt 14; and releasably adhering fabric 20 that is directly affixed on the belt 14 or waist-hanging clothing 10 such as pants, skirt, etc. a belt provides the support distributed on the waist area.

Since the inventive support does not require permanent modifications to the wood or shape of a guitar 1 (e.g., by screwing something extra onto the back, e.g., by gluing something on), then the value of the instrument 1 is not decreased and the tone quality is not compromised.

The inventive support is made from materials that will minimize damage to the back 2 of the instrument, thereby preserving the value of possibly very expensive instruments 1. For example, if hook/loop fabric 20 is used in its traditional form, then the hook fabric 20*a* is used where the hooks will not touch the instrument back 2, and the generally softer loop fabric 20*b* is used wherever it could rub against the back 2. Likewise other elements that could rub against the instrument back 2 (e.g., adjustable slider 34) are made of soft surfaced materials (e.g., soft plastic) and/or are covered with a non-marring material (e.g., cloth, leather).

The inventive support augments rather than hinders performances particularly since it enables simple, quick and easy attachment and removal of the instrument 1 to/from the user. Additionally the inventive support is quickly and easily detached and reattached to another instrument, and it enables use (e.g., playing) of the instrument 1 while standing, sitting, walking, gyrating, and while transitioning between these modes of play. Furthermore, rigid forms of the inventive support (e.g., 52, 60) can also minimize twisting moments that cause the neck 3 of the guitar 1 to weigh down on the fingering hand of the musician, thereby enabling better and longer playing as well as more varied playing styles (e.g., string tapping).

The inventive support is not readily noticed because it is covered mostly by the instrument 1 while in use, and can be made in a variety of decorative shapes and appearances to enhance the user's costume when not supporting an instrument 1.

Prototype testing of the inventive support apparatus has demonstrated a significantly noticeable reduction in weight and stress on a user's shoulder/neck area and back. Since many musicians prefer to rehearse as well as perform while standing, long rehearsals leads to fatigue in the muscle areas supporting the instrument, even for those in good health, and of course the support can be extremely beneficial to anyone who has suffered any back, neck, or shoulder problems.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A support structure for an instrument whereby the instrument can be supported by the lower body of a user of the instrument while the instrument is being used, the support structure comprising:

a patch of a releasably adhering fabric that is removably attached to a back of the instrument, wherein a removable attachment is easily unattached without damaging the back of the instrument; and a hanger comprising a removable attachment to the user's lower body, and a releasably adhering fabric that releasably adheringly mates with the releasably adhering fabric of the patch on the instrument.

2. The support structure of claim 1, wherein:

the patch is affixed to a removable and replaceable component of the instrument.

3. The support structure of claim 1, wherein:

the removable attachment of the hanger to the user's lower body comprises attachment to apparel worn on the user's lower body.

4. The support structure of claim 3, wherein the hanger comprises:

releasably adhering fabric that is permanently attached to, or made as a part of, the apparel.

5. The support structure of claim 3, wherein the hanger further comprises:

a loop of material that hangs from a belt type of apparel.

6. The support structure of claim 3, wherein the hanger further comprises:

an at least semi-rigid material that is removably or permanently attached to, or made a part of, a belt type of apparel.

7. The support structure of claim 6, wherein:

the hanger positions the releasably adhering fabric above the level of the belt.

8. The support structure of claim 1, wherein:

the instrument is a musical instrument normally supported by a conventional strap that places the instrument's weight upon the neck and/or shoulder of the user; and the support structure supplements the conventional strap.

9. The support structure of claim 1, wherein:

the releasably adhering fabric is a hook/loop fabric.

10. A method for supporting an instrument while it is being used such that the instrument's weight is mostly bourn by the lower body of the instrument user due to a removable attachment of the instrument to apparel worn on the lower body, and wherein the removable attachment can be attached or removed while the instrument is being used, the method comprising the steps of:

attaching a patch of a releasably adhering fabric to a back of the instrument;

attaching a hanger to the apparel, the hanger comprising a releasably adhering fabric that will mate with the releasably adhering fabric of the patch on the instrument;

supporting the instrument by mating the releasably adhering fabric of the hanger with that of the patch, wherein the mating is accomplished when the two fabrics are pressed together as the user presses the instrument against the apparel on the user's body; and removing support for the instrument by pulling the releasably adhering fabric of the hanger apart from that of the patch, wherein the pulling apart is accomplished by the user pulling the instrument away from the apparel on the user's body.

11. The method of claim 10, further comprising the step of:

removably attaching the patch to the instrument back such that the patch is easily unattached without damaging the instrument.

12. The method of claim 10, further comprising the step of:

affixing the patch to a removable and replaceable component of the instrument.

13. The method of claim 10, wherein the step of attaching the hanger to the apparel further comprises:

permanently attaching the releasably adhering fabric of the hanger to the apparel, or making the releasably adhering fabric as a part of the apparel.

14. The method of claim 10, wherein the step of attaching the hanger to the apparel further comprises:

hanging a loop of material from a belt type of apparel; and attaching the releasably adhering fabric of the hanger to the material.

15. The method of claim 14, further comprising the step of:

making the loop of material adjustable in length.

16. The method of claim 10, wherein the step of attaching the hanger to the apparel further comprises:

removably or permanently attaching an at least semi-rigid material to, or making a part of, a belt type of apparel; and attaching the releasably adhering fabric of the hanger to the at least semi-rigid material.

17. The method of claim 16, further comprising the step of:

forming the hanger such that it positions the releasably adhering fabric above the level of the belt.

18. The method of claim 10, wherein the instrument is a musical instrument normally supported by a conventional strap that places the instrument's weight upon the neck and/or shoulder of the user, the method further comprising the step of:

using a conventional strap to supplement the method for supporting the instrument.

19. The method of claim 10, wherein:

the releasably adhering fabric is a hook/loop fabric.

20. A support structure for an instrument whereby the instrument can be supported by the lower body of a user of the instrument while the instrument is being used, the support structure comprising:

a patch of a releasably adhering fabric that is attached to a back of the instrument, and a hanger that is removably attachable to the user's lower body, the hanger comprising a releasably adhering fabric that will mate with the releasably adhering fabric of the patch on the instrument;

wherein the removable attachment of the hanger to the user's lower body comprises attachment to apparel worn on the user's lower body; and the hanger comprises releasably adhering fabric that is permanently attached to, or made as a part of, the apparel.

* * * * *